US009151484B1

(12) United States Patent
Olsson et al.

(10) Patent No.: US 9,151,484 B1
(45) Date of Patent: Oct. 6, 2015

(54) LED LIGHTING DEVICES AND SYSTEMS FOR MARINE AND SHORELINE ENVIRONMENTS

(71) Applicants: Mark S. Olsson, La Jolla, CA (US); Jon E. Simmons, Poway, CA (US); John R. Sanderson, Poway, CA (US); Steven B. Weston, San Diego, CA (US)

(72) Inventors: Mark S. Olsson, La Jolla, CA (US); Jon E. Simmons, Poway, CA (US); John R. Sanderson, Poway, CA (US); Steven B. Weston, San Diego, CA (US)

(73) Assignee: DEEPSEA POWER & LIGHT, INC., San Diego, CA (US)

( * ) Notice: Subject to any disclaimer, the term of this patent is extended or adjusted under 35 U.S.C. 154(b) by 54 days.

(21) Appl. No.: 13/662,804

(22) Filed: Oct. 29, 2012

Related U.S. Application Data

(60) Provisional application No. 61/553,123, filed on Oct. 28, 2011.

(51) Int. Cl.
*F21V 31/00* (2006.01)

(52) U.S. Cl.
CPC ..... *F21V 31/00* (2013.01)

(58) Field of Classification Search
CPC ..... F21V 31/00; F21V 25/10; F21V 31/005; F21V 31/03; F21V 31/04; B63B 2201/08; F21W 2111/04
USPC ..... 362/477, 105
See application file for complete search history.

(56) References Cited

U.S. PATENT DOCUMENTS

| | | | | |
|---|---|---|---|---|
| 4,629,366 | A * | 12/1986 | Rutherford et al. | 204/196.17 |
| 5,322,569 | A * | 6/1994 | Titus et al. | 134/1 |
| 5,332,329 | A * | 7/1994 | Hill et al. | 403/261 |
| 6,077,220 | A * | 6/2000 | Rudischhauser et al. | 600/162 |
| 6,457,838 | B1 * | 10/2002 | Dugmore et al. | 362/106 |
| 6,752,516 | B1 * | 6/2004 | Beadle | 362/647 |
| 7,011,436 | B2 * | 3/2006 | Riebling et al. | 362/487 |
| 2005/0111222 | A1 * | 5/2005 | Olsson et al. | 362/267 |
| 2007/0097675 | A1 * | 5/2007 | Koren et al. | 362/158 |
| 2007/0139913 | A1 * | 6/2007 | Savage | 362/101 |
| 2008/0137329 | A1 * | 6/2008 | Fee | 362/231 |
| 2008/0232105 | A1 * | 9/2008 | Saha et al. | 362/267 |
| 2010/0020541 | A1 * | 1/2010 | Incorvia et al. | 362/249.01 |

FOREIGN PATENT DOCUMENTS

EP 2744060 A1 * 6/2014

* cited by examiner

*Primary Examiner* — Diane Lee
*Assistant Examiner* — Naomi M Wolford
(74) *Attorney, Agent, or Firm* — Steven C. Tietsworth, Esq.

(57) ABSTRACT

Lighting apparatus or luminaires for use in wet, humid, or underwater environments are disclosed. The luminaire may include a plastic housing block, port assembly including a copper or copper alloy fitting and transparent port window disposed within the housing block, and a compound LED light-engine unit.

14 Claims, 11 Drawing Sheets

LED LIGHTING DEVICES AND SYSTEMS FOR MARINE AND SHORELINE ENVIRONMENTS

CROSS-REFERENCE TO RELATED APPLICATIONS

This applications claims priority under 35 U.S.C. §119(e) to U.S. Provisional Patent Application Ser. No. 61/553,123, entitled LED LIGHTING DEVICES AND SYSTEMS FOR MARINE AND SHORELINE ENVIRONMENTS, filed on Oct. 28, 2011, the content of which is incorporated by reference herein in its entirety for all purposes.

FIELD

The present disclosure relates generally to devices and systems for environmental lighting of docks, piling structures, piers, bulkheads, floats and related marine and shoreline use. More specifically, but not exclusively, the disclosure relates to a lighting apparatus including a plastic housing, port assembly including a copper or copper alloy fitting, transparent port window, and compound LED light-engine unit.

BACKGROUND

Environmental lighting is widely used in domestic, commercial and public environments. In marine environments such as marinas, docks, and the like, underwater lighting provides enhanced visibility for dockside operations and near-shore navigation, as well as providing aesthetic improvements to the look of dock areas. However, the marine boundary region is a harsh environment chemically and mechanically due to the effects of tides, weather, salt water, and other marine conditions, thereby requiring non-standard lighting devices and systems.

SUMMARY

The present disclosure relates generally to systems for environmental lighting of docks, piling structures, piers, bulkheads, floats and related marine and shoreline use, and more specifically to a light fixture of variable configuration with a compound LED light-engine unit.

More specifically, but not exclusively, the disclosure relates to environmental lighting devices in which a multi-LED light engine is fitted to a suitably robust and protected fixtures for deployment in underwater illumination of dockside areas, the edges of floats, shoreline bulkheads, piers, or similar littoral sites or other sites where full or partial submersion may occur or humidity is present.

For example, in one aspect, the disclosure relates to a submersible lighting apparatus or luminaire. The luminaire may include, for example, a housing block, which may be metallic or non-metallic. The luminaire may further include an LED light engine assembly. The light engine assembly may include one or more LEDs and one or more LED driver electronics circuits. The LEDs and/or LED driver electronics circuits may be disposed within the housing block and/or may be potted within the housing block or other assemblies of the luminaire. The potting may be done with a two step potting process.

In another aspect, the disclosure relates to a submersible LED lighting apparatus. The apparatus may include a PVC housing block, a metallic LED light engine assembly potted within the PVC housing block, a port assembly including a sapphire port and a copper or copper alloy fitting disposed on the PVC housing block, a zinc anode disposed in contact with the port assembly, the zinc anode configured to retain the port assembly in the PVC housing block, and an electrical power assembly including a strain relief element coupled to the PVC housing block and a wire assembly coupled to the LED light engine. The housing block may include a substantially flat face and the sapphire port and fitting may be disposed in the housing to form a flush surface to facilitate cleaning and maintenance.

In another aspect, a submersible lighting unit may include a housing and a transparent pressure bearing window at the forward end of the housing, behind which a window supporting structure may be mounted. A fitting, such as a copper-alloy fitting, may include a press-fit ring which seats the window support and the window in a forward end, and fits within the housing. Water-tight seals may be provided for the fitting and for the larger housing. Electrolytic anodes may be fitted, such as by using set-screws, which may aid in holding the fitting within the housing.

In another aspect, the disclosure relates to a submersible lighting apparatus or luminaire. The luminaire may include, for example, a housing block, an LED light engine assembly disposed within the housing block, a port assembly, and an electrical power assembly.

In another aspect, the disclosure relates to a submersible LED lighting apparatus. The submersible LED lighting apparatus may include, for example, a PVC housing block, a copper alloy LED light engine assembly potted within the PVC housing block, a port assembly including a sapphire port disposed on the PVC housing block, a zinc anode disposed in contact with the port assembly, the zinc anode configured to retain the port assembly in the PVC housing block, and an electrical power assembly including a strain relief element coupled to the PVC housing block and a wire assembly coupled to the LED light engine.

In another aspect, the disclosure relates to a method of manufacturing an LED lighting apparatus. The method may include, for example, potting a first set of components to create a lighting apparatus sub-assembly and potting the lighting apparatus sub-assembly into a housing block.

In another aspect, the disclosure relates to methods of operation and use of an LED lighting apparatus or luminaire as described above.

In another aspect, the disclosure relates to fixtures for mounting an LED lighting apparatus or luminaire as described above on a dock, pier, boat or other vessel, or other structure.

Various additional aspects, details, features, and functions are further described below in conjunction with the appended Drawings.

BRIEF DESCRIPTION OF THE DRAWINGS

The present application may be more fully appreciated in connection with the following detailed description taken in conjunction with the accompanying drawings, wherein.

DETAILED DESCRIPTION OF EMBODIMENTS

Figure 1:
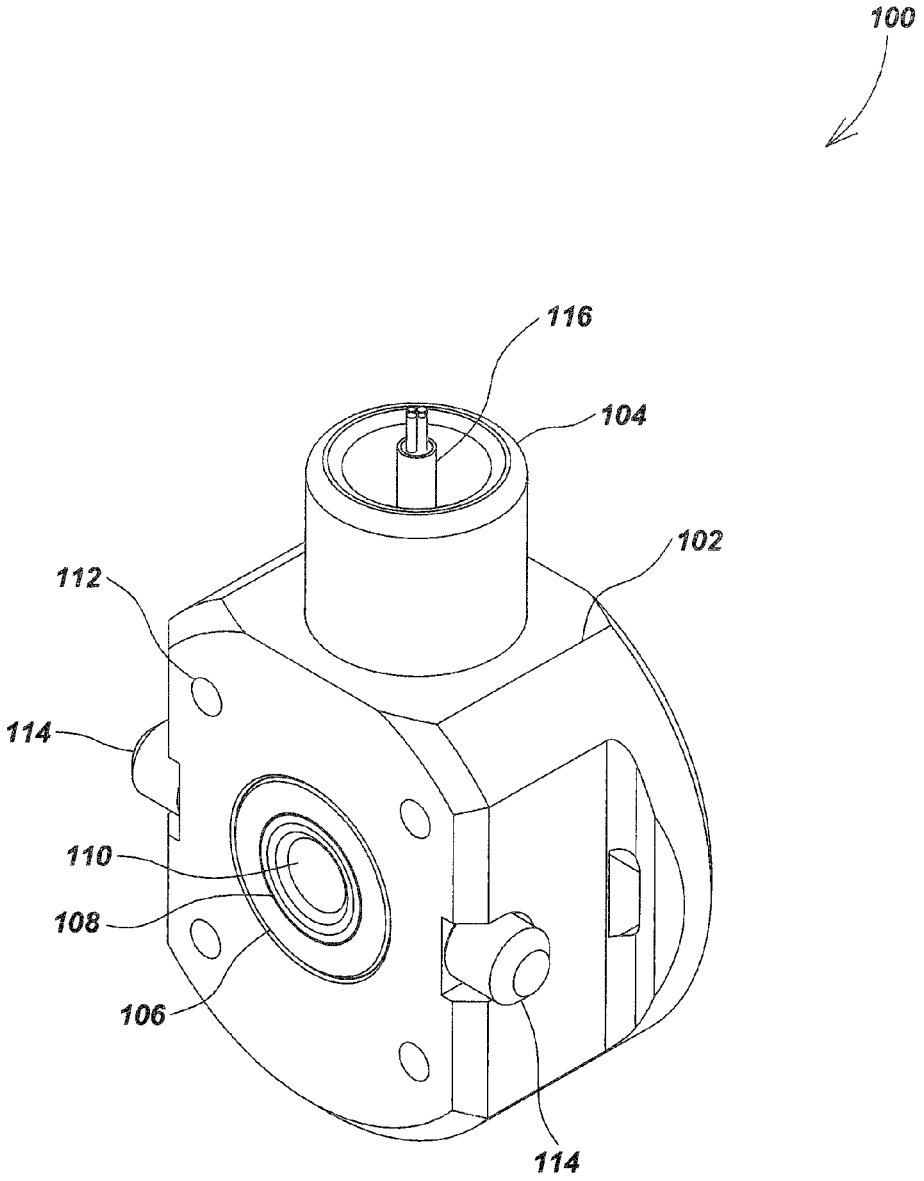
FIG. 1 is an external front isometric view of an embodiment of a marine illumination device including a compound LED illumination unit.

The present disclosure relates generally to devices, systems, and methods for providing environmental lighting. More specifically, but not exclusively, the present disclosure relates to environmental lighting systems for marine and littoral underwater use, wherein a compound LED light engine enclosed in a milled form may be mounted below the waterline to structures such as pilings, docks, piers, cables, and the like to provide underwater illumination. Various embodiments may be used for purposes such as enhancing the aesthetics of a marine or shoreline environment, as well as increasing visibility and/or safety of working areas in such environments.

In accordance with various aspects, a submersible LED lighting device for use in marine, shoreline, dock, or similar environments (also denoted herein as a "marine light" or "submersible luminaire" for brevity) may include a housing block, a port assembly coupled to the housing block, a sacrificial anode, an LED light engine assembly, and an electrical power assembly configured to provide electrical power to the light engine. In operation, a submersible luminaire may be configured to be operated while fully or partially submerged, in salt or fresh water, either continuously or during certain time intervals (such as based on tides, waves, currents, etc.).

For example, in one aspect, the disclosure relates to a submersible lighting apparatus or luminaire. The luminaire may include, for example, a housing block, which may be metallic or non-metallic. The luminaire may further include an LED light engine assembly. The light engine assembly may include one or more LEDs and one or more LED driver electronics circuits. The LEDs and/or LED driver electronics circuits may be disposed within the housing block and/or may be potted within the housing block or other assemblies of the luminaire. The potting may be done with a two step potting process.

The luminaire may further include, for example, a port assembly. The port assembly may include a transparent port window and a fitting. The luminaire may further include an electrical power assembly. The electrical power assembly may be wholly or partially integral with the light engine assembly or may be separate from the light engine assembly. The electrical power assembly may be configured to provide battery power or line or other electrical power to the luminaire and associated components, such as the driver electronics circuits and LEDs.

The housing block may, for example, comprise a plastic material, such as a PVC material or other plastic material. Alternately, or in addition, the housing block may comprise a metallic, ceramic, or other material suitable for immersion in water or other fluids. The housing block may include an external mounting assembly. The external mounting assembly may be configured to facilitate attachment of the lighting apparatus to an external structure. The external mounting assembly may include a custom fitting or standard fitting, such as a fitting configured to couple to a standard PVC pipe or PVC pipe fitting or other type of pipe or pipe fitting.

The luminaire may further include, for example, one or more sacrificial elements disposed on or within or coupled to the housing block. The sacrificial element may be a zinc anode or another sacrificial element and/or associated electrical elements or circuitry.

The luminaire may further include, for example, a sequestering agent or browning agent destroyer. The sequestering agent/browning agent destroyer may be disposed within the housing block, such as on or in the light engine assembly and/or on or in proximity to the LEDs or driver or power supply circuitry.

The port assembly fitting may be, for example, a copper or copper alloy fitting or fitting of other anti-fouling materials to mitigate underwater fouling in proximity to the port and transparent port window. The fitting may be disposed on or within the housing to be in contact with the exterior of the luminaire to mitigate underwater fouling. The LEDs may be driven continuously in the housing to mitigate fouling through heating of the port assembly and/or adjacent housing block areas. One or more of the LEDs of the light assembly may be configured to operate so as to mitigate fouling. The LEDs may be blue or ultraviolet LEDs or other LEDs or light generating elements operating at a wavelength or wavelength range selected to mitigate underwater fouling of the transparent port window. The transparent window may be a sapphire window or other transparent window material, such as glass or plastic materials or nanostructured optical materials.

The LED light engine and/or LED driver electronics circuit and/or power supply circuit may be potted in the housing block. Alternately, or in addition, the LED light engine and/or LED driver electronics circuit and/or power supply circuit may be disposed in the housing to be removable, such as through a slip or friction fit or threaded fit or keyed fit or other removable coupling. The housing block and/or electrical power assembly may include one or more strain relief elements. A wire assembly for providing electrical power and/or control signaling to the LED light engine may be disposed within or through the strain relief assembly. The strain relief element may comprise a PVC material suitable for bonding to a PVC mounting pipe using a PVC adhesive or material suitable to bond to other pipe types using an adhesive. The housing assembly may include a pipe coupling structure. The pipe coupling structure may be configured to be coupled to a standard pipe element. The standard pipe element may be a PVC pipe or PVC pipe fitting.

The luminaire may further include, for example, a thermal control circuit for reducing and/or shutting off output light to reduce heating. The thermal control circuit may comprise a thermal foldback or shutoff circuit coupled to the LED light engine assembly and/or electrical power circuit and/or LED driver circuit to control LED light output in response to thermal overheating conditions or other conditions such as humidity, temperature, or other out of range physical or operational parameters.

The housing block may, for example, include a flat face area and/or smoothly-curved face area to facilitate maintenance and cleaning. A front face area of the port assembly and/or LED light engine assembly may be positioned to be substantially flush with the flat face area or smoothly curved face area to facilitate cleaning of the lighting assembly.'

In another aspect, the disclosure relates to a submersible LED lighting apparatus. The apparatus may include a PVC housing block, a metallic LED light engine assembly potted within the PVC housing block, a port assembly including a sapphire port and a copper or copper allow fitting disposed on the PVC housing block, a zinc anode disposed in contact with the port assembly, the zinc anode configured to retain the port assembly in the PVC housing block, and an electrical power assembly including a strain relief element coupled to the PVC housing block and a wire assembly coupled to the LED light engine. The housing block may include a substantially flat face and the sapphire port and fitting may be disposed in the housing to form a flush surface to facilitate cleaning and maintenance.

In another aspect, a submersible lighting unit may include a housing and a transparent pressure bearing window at the forward end of the housing, behind which a window supporting structure may be mounted. A fitting, such as a copper-alloy fitting, may include a press-fit ring which seats the window support and the window in a forward end, and fits within the housing. Water-tight seals may be provided for the fitting and for the larger housing. Electrolytic anodes may be fitted, such as by using set-screws, which may aid in holding the fitting within the housing.

In another aspect, the disclosure relates to a submersible lighting apparatus or luminaire. The luminaire may include, for example, a housing block, an LED light engine assembly disposed within the housing block, a port assembly, and an electrical power assembly.

The housing block may be made from, for example, a plastic material. The plastic material may be a PVC material or other plastic material. Alternately or in addition, the housing block may include a metallic material. Alternately or in addition, the housing block may include a ceramic material. The housing block may include an external mounting assembly configured to facilitate attachment of the lighting apparatus to an external structure.

The lighting apparatus may further include, for example, a sacrificial element coupled to the housing block. The sacrificial element may be a zinc anode. The sacrificial element may be configured to retain the port assembly in the housing block. The port assembly may include a copper alloy fitting, and the sacrificial element may be a zinc anode configured to retain the copper alloy fitting in the housing block with a set screw.

The LED light engine assembly may include, for example, one LED element or a plurality of LED elements. The LED light engine may be made substantially all with a metallic material. The metallic material may be a copper or copper alloy material.

The port assembly may include, for example, a copper-alloy fitting and a port. The port may be is a sapphire port. The port may be a glass or plastic material. The lighting apparatus may further include a ring assembly configured to retain the port element within the housing block.

The electrical power assembly may include, for example, a strain relief element and a wire assembly. The strain relief element may include a sloped inner channel configured to retain the wire assembly. The electrical power assembly may further include a clamping element, such as an Oetiker clamp. The electrical power assembly may include a battery assembly. The strain relief element may be configured to be coupled to a standard-sized PVC pipe to facilitate mounting to an external structure such as a pier or dock. The strain relief element may be made from a PVC material suitable for bonding to the PVC pipe using a PVC glue. The lighting apparatus may be glued to the PVC pipe, which may be attached to a dock, pier or other external structure.

The LED light assembly may be potted within the housing block. The LED light assembly may be potted within the housing block using a two step potting process. The two step potting process may include potting a first set of elements of the lighting apparatus into a potted sub-assembly and potting the sub-assembly into the housing block.

The lighting assembly may further include, for example, a sensor circuit and a control circuit for controlling LED light output. The sensor circuit may include a temperature sensor. The sensor circuit may include a pressure sensor. The sensor circuit may include a moisture sensor. The control circuit may include a thermal foldback or shutoff circuit. The control circuit may be coupled to the sensor circuit and LED light engine assembly to control LED light output in response to thermal or other conditions.

The housing block may be configured with a flat face. A front face of the port assembly and LED light engine assembly may be positioned to be substantially flush with the flat face of the housing block to facilitate cleaning of the lighting assembly.

In another aspect, the disclosure relates to a submersible LED lighting apparatus. The submersible LED lighting apparatus may include, for example, a PVC housing block, a copper alloy LED light engine assembly potted within the PVC housing block, a port assembly including a sapphire port disposed on the PVC housing block, a zinc anode disposed in contact with the port assembly, the zinc anode configured to retain the port assembly in the PVC housing block, and an electrical power assembly including a strain relief element coupled to the PVC housing block and a wire assembly coupled to the LED light engine.

In another aspect, the disclosure relates to a method of manufacturing an LED lighting apparatus. The method may include, for example, potting a first set of components to create a lighting apparatus sub-assembly and potting the lighting apparatus sub-assembly into a housing block.

The first set of components may include, for example, two or more of a press-fit ring, a sapphire port, a light engine assembly, a port O-ring, a metallic support, a thermal compound layer, and dessicant spheres. The first set of components may be combined with a thermal protection PCB and potted into the housing block.

Various related aspects and details of that may be used in conjunction with the instant disclosure for implementing embodiments of underwater lighting apparatus, systems, and methods are described in the following commonly assigned applications: U.S. Utility patent application Ser. No. 12/036,178, entitled LED ILLUMINATION SYSTEMS AND METHODS OF FABRICATION, filed Feb. 22, 2008, U.S. Utility patent application Ser. No. 12/185,007, entitled DEEP SUBMERSIBLE LIGHT WITH PRESSURE COMPENSATION, filed Aug. 1, 2008, U.S. Utility patent application Ser. No. 12/844,759, entitled SUBMERSIBLE LED LIGHT FIXTURE WITH MULTILAYER STACK FOR PRESSURE TRANSFER, filed Jul. 27, 2010, U.S. Provisional Patent Application Ser. No. 61/536,512, entitled LIGHT FIXTURE WITH INTERNALLY-LOADED MULTILAYER STACK FOR PRESSURE TRANSFER, filed Sep. 19, 2011, U.S. Utility patent application Ser. No. 13/271,166, entitled PATHWAY ILLUMINATION DEVICES, METHODS, AND SYSTEMS, filed Oct. 11, 2011, and U.S. patent application Ser. No. 13/482,969, entitled SEMICONDUCTOR LIGHTING DEVICES AND METHODS, filed May 29, 2012. The content of each of these applications is hereby incorporated by reference herein in its entirety. These applications may be referred to collectively herein as the "Related Applications."

Lighting devices and systems intended for use in marine and shoreline environments often face difficult operating conditions. Consequently, lighting devices and systems for operating in such environments should be designed for robust simplicity, secure mounting, good thermal control, as well as weather resistance.

Semiconductor LEDs have widely replaced other lighting sources in many applications due to the advantages of long life, robustness, and color rendering capabilities. LED devices are becoming more generally accepted in marine applications for the advantages they provide, including instant on/off, color purity, vibration resistance, long operating life, as well as energy efficiency. LED lights of appropriate wavelengths may advantageously used to mitigate fouling of lights in underwater environments by killing marine organisms. These lights may be further combined with elements of housing and/or port assemblies with anti-fouling properties, such as copper or copper alloys or other anti-fouling materials.

Turning to the drawings, FIG. 1 illustrates details of an exemplary embodiment 100 of such an underwater lighting apparatus or submersible luminaire. Submersible luminaire embodiment 100 includes a housing block 102 and an electrical power assembly including a strain relief element 104 for restraining a wire assembly 116. Strain relief element 104 may be configured to contain and/or restrain wire assembly 116 and may be configured as a structural element to couple to a proprietary coupling assembly or a standard pipe or pipe fitting, such as a PVC or other plastic pipe, metallic pipe, etc. Both the housing block 102 and the strain relief element 104 may be formed of plastics, such as PVC, or other materials, such as ceramics, metals, or other materials suitable for use in a marine or underwater environment. Strain relief element 104 may be integral with housing block 102 or may attached to housing block 102 using threads, adhesives, screws, o-rings, and the like. By configuring strain relief element 104 in a size and shape to match a standard pipe element such as a PVC pipe, the lighting apparatus may be glued to lengths of standard PVC pipe (or other plastic or metallic materials) using PVC glue or other adhesives, thereby facilitating ease of installation and customization. In alternate embodiments, strain relief element 104 may be threaded to screw onto proprietary or standard threaded connectors, such as standard-sized PVC or other metal or plastic connectors. By using threaded couplings, lighting apparatus may be readily removed for cleaning, maintenance, replacement, etc.

Housing block 102 may be configured from thermal dissipation materials and may further include structures (not shown) for providing thermal dissipation of heat generated by one or more light engine assemblies disposed within. In an exemplary embodiment, both housing block 102 and strain relief element 104 are formed or molded with PVC or other plastic materials.

One or more port assemblies may be disposed on or within the housing block to allow light from one or more LED light engines exit the housing block. For example, on a surface of the housing block, such as a front planar face of housing block 102 as shown, a central circular opening may be included to hold a fitting, such as a milled fitting 106 as shown, which may be copper or a copper alloy, or other metal, plastic, or ceramic materials, into which may be fitted a ring assembly, such as formed press-fit ring 108 or other elements for retaining a port element, such as a port 110 including a transparent window of sapphire or other transparent materials (or a port comprising other materials, such as glass or plastic materials) as shown. Copper may be advantageously used in an exemplary embodiment to mitigate fouling of the light in underwater environments. Heating of the port by the LEDs and/or other thermal dissipation structures coupled to the port may be further used to mitigate fouling. Alternately, or in addition, LED lighting elements configured to operate in certain wavelengths may be used to further mitigate fouling. For example, one or more LED lighting elements may operate in the blue, ultraviolet, or other wavelengths to kill underwater plant and/or invertebrate or other animal organisms.

Although embodiment 100 illustrates one port, in various other embodiments, two or more ports may be included, such as on opposite sides of housing block 102 and/or on the top, bottom, or side(s). In an exemplary embodiment, the mounting surface of the port on the housing block 102 may be shaped or formed to be substantially flat or smoothly curved so that the port 110 and LED light engine (positioned inside the port and internal to the housing block) may be mounted substantially flush in the housing block exterior to aid in cleaning of the luminaire. Alternately, the front face of the port assembly and/or LED light engine may be stepped outward or inward from the housing body in some embodiments to aid in assembly, mounting, light directional control, and the like.

The fitting 106, ring assembly 108, and transparent port window 110 may comprise the port assembly. The housing block 102 may include external mounting elements, such as the four mounting holes 112 drilled through it for attaching the luminaire 100 to a desirable location. In some embodiments, various light output control elements (not shown in FIG. 1), such as filters, diffusers, gobos, or other elements as described in, for example, U.S. Utility patent application Ser. No. 13/271,166, entitled PATHWAY ILLUMINATION DEVICES, METHODS, AND SYSTEMS, which is incorporated by reference herein, may be included in or coupled to housing block 102 to control light output from luminaire 100.

One or more sacrificial anodes may optionally be mounted on or within or coupled to luminaire 100 for electrolysis control. For example, on the left and right side of the housing block 102 two cut-away recesses may be formed, each of which may contain a sacrificial anode material, such as zinc anode 114 or other sacrificial materials. The sacrificial anodes may be further configured to aid in attaching or retaining elements of the luminaire, such as the port assembly or components of the port assembly.

A strain relief element 104 may be used to guide and protect electrical power wiring, such as an 18 AWG 2-stranded power supply wire 116, which typically may include a Kevlar braid covering or other insulating and/or protective covering material. In other embodiments, the electrical power assembly may comprise batteries and/or battery mounting and coupling assemblies (not shown in FIG. 1) for providing internal battery power rather than wired input power. In addition, strain relief element 104 may be configured to aid in mounting the luminaire by facilitating connections to a pipe, such as a PVC pipe, or other element to attach the luminaire 100 on an external structure such as a dock, wall, pier, and the like. Alternately, or in addition, the housing block 102 may be similarly configured to connect to a pipe or other element for mounting of the luminaire.

Figure 2:
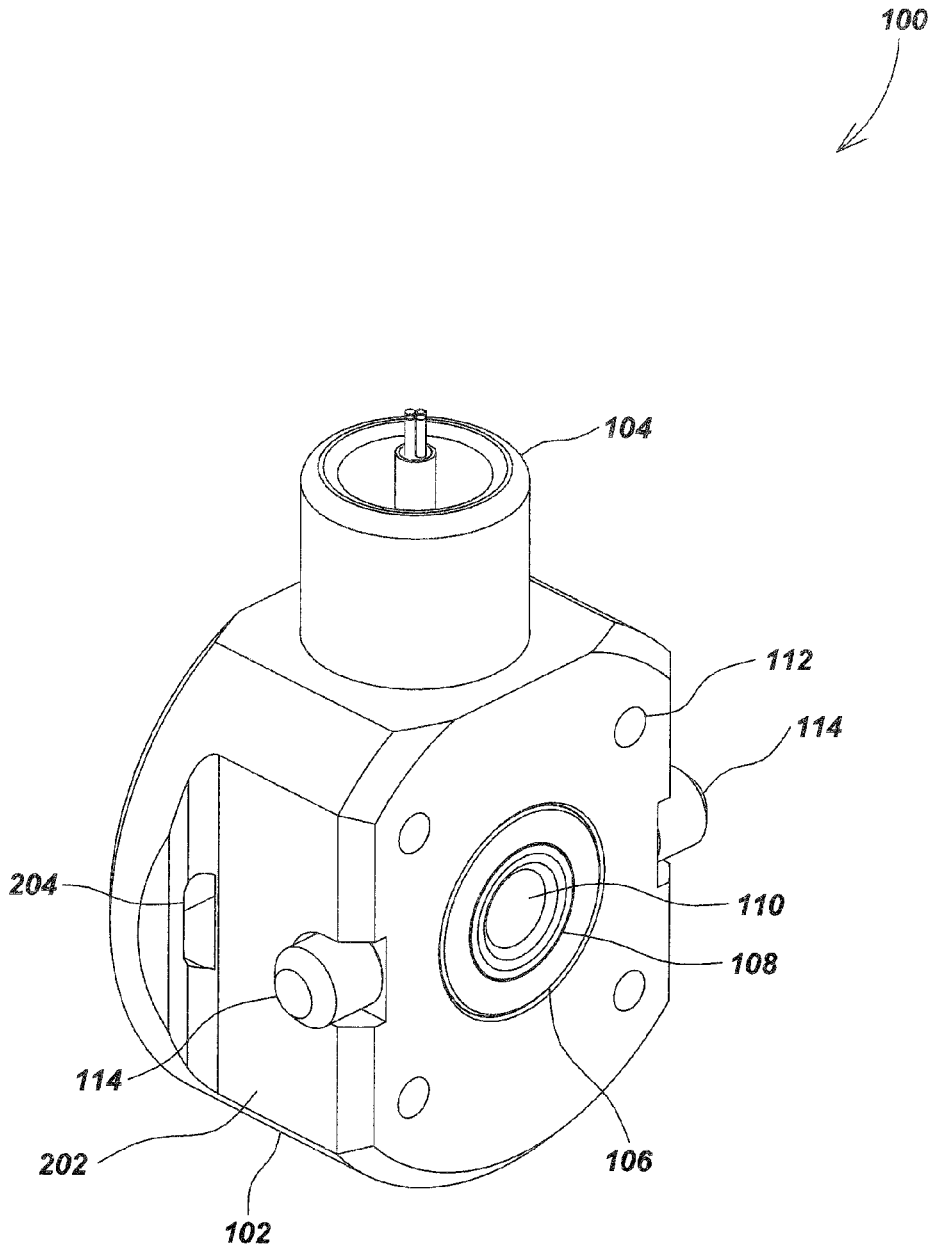
FIG. 2 is a right front isometric view of the illumination device embodiment of FIG. 1.

FIG. 2 illustrates an isometric view of luminaire embodiment 100 from the right side. As shown in FIG. 2, housing block 102 may be symmetrically formed and may have a side recess 202 on one or both sides. At the base of each side recess an opening 204 may be used, in place of or in addition to a pipe connection as described above, for attachment of the luminaire 100 to a pier, dock support, cable, sea-wall or the like. Slotted ears with a slot in back (such as shown in FIG. 3) may be used to allow flush-mounting of the luminaire to a dock, piling, or other structure.

Because electrolysis is a continuous threat to metal devices in salt water or other conductive liquid environments, a marine light, such as submersible luminaire 100, may be equipped with sacrificial elements, such as zinc or other sacrificial metals. For example, as described previously herein, one or more zinc anodes 114 may be used as a sacrificial source for oxidation. Anodes 114 may be mounted on a set-screw (not shown), which may be in contact with an element such as milled copper-alloy fitting 106 of the port assembly to provide an electrical path and/or to aid in providing mechanical retention of the port assembly and copper-alloy fitting 106 within the housing block 102.

Figure 3:
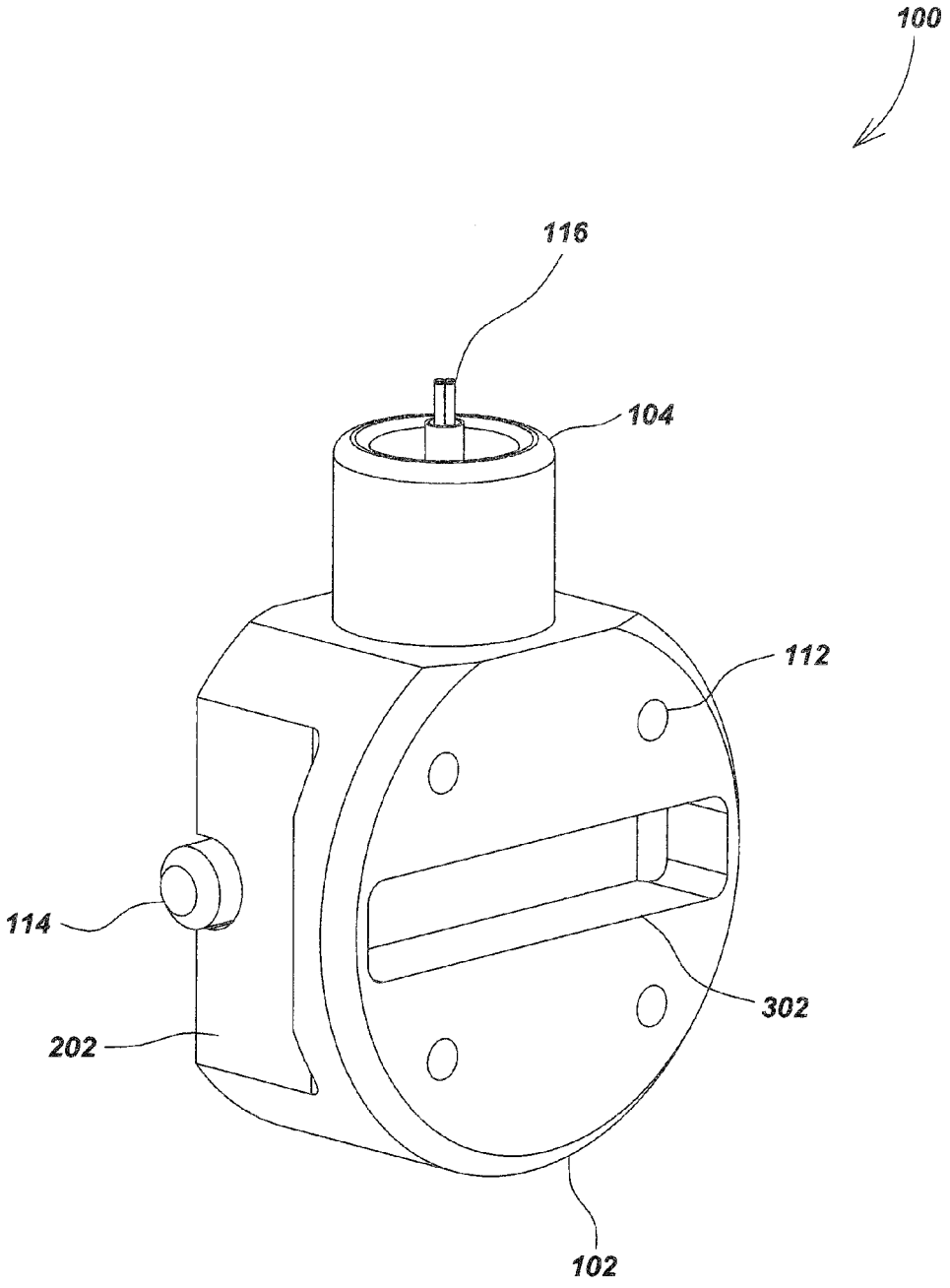
FIG. 3 is a rear isometric view of the illumination device embodiment of FIG. 1.

FIG. 3 illustrates a rear view of luminaire embodiment 100. A back plane of housing block 102 may be formed with a back recess 302 or other structure configured to couple with side recess 202 (as shown in FIG. 2) and allow luminaire 100 to be readily mounted by a strap or other mounting mechanism, depending on the desired mounting location.

Figure 4:
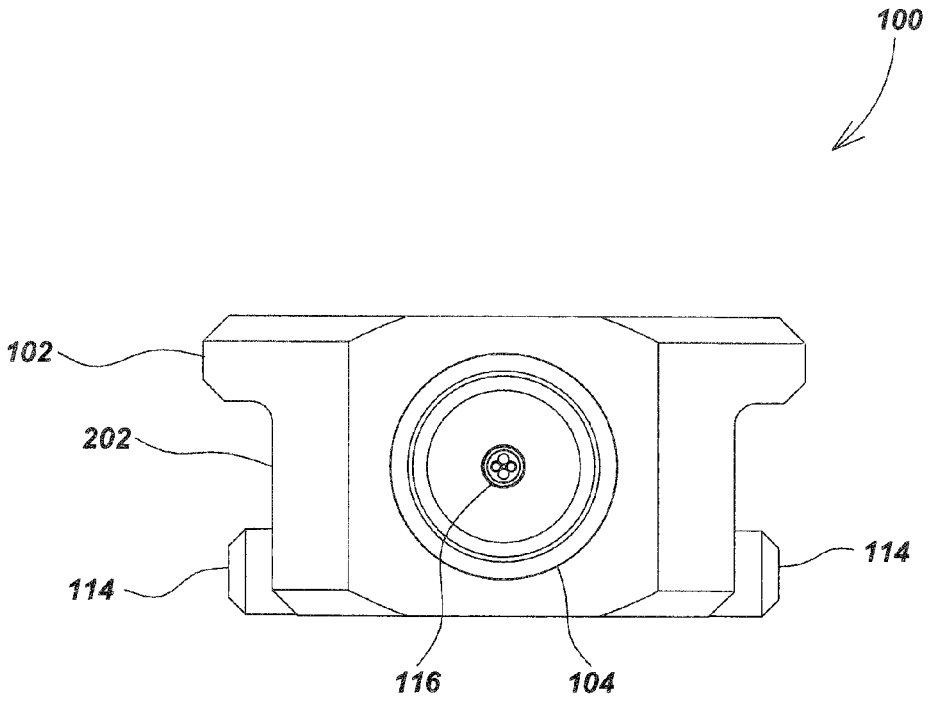
FIG. 4 is a top view of the illumination device embodiment of FIG. 1.

Turning to FIG. 4, luminaire embodiment 100 is shown from the top. A power supply wire 116 may enter housing block 102 by a central opening, such as in the strain relief element 104 as shown.

Figure 5:
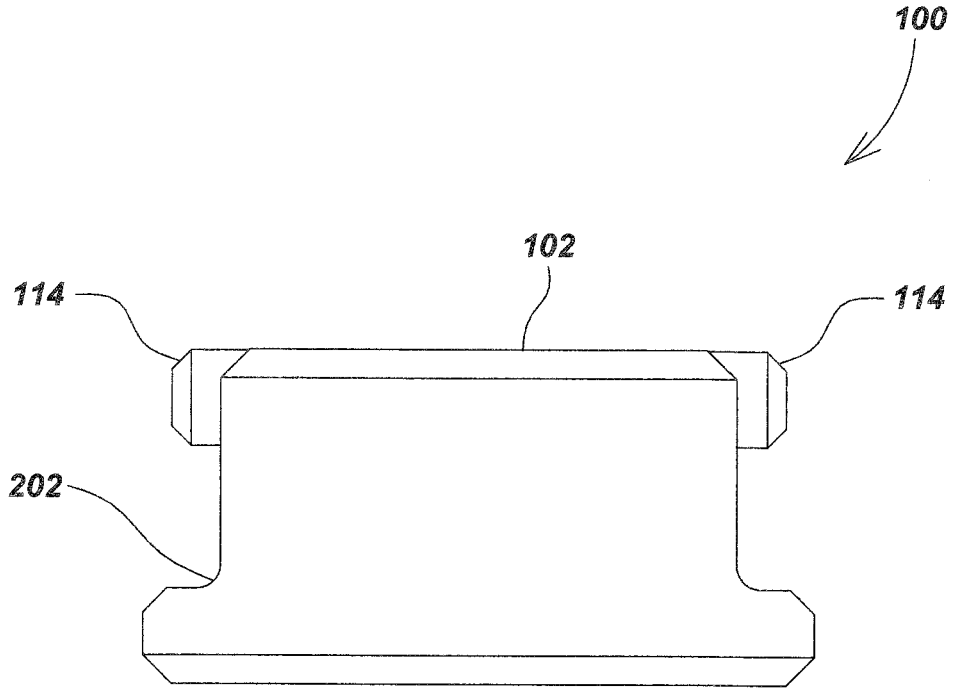
FIG. 5 is a bottom view of the illumination device embodiment of FIG. 1.

Turning to FIG. 5, luminaire embodiment 100 is shown from the bottom of housing block 102. Electrolytic anodes 114 are shown projecting from both sides of the central portion of housing block 102. Alternately, other sacrificial element types, numbers, and configurations may alternately be used in various embodiments.

Figure 6:
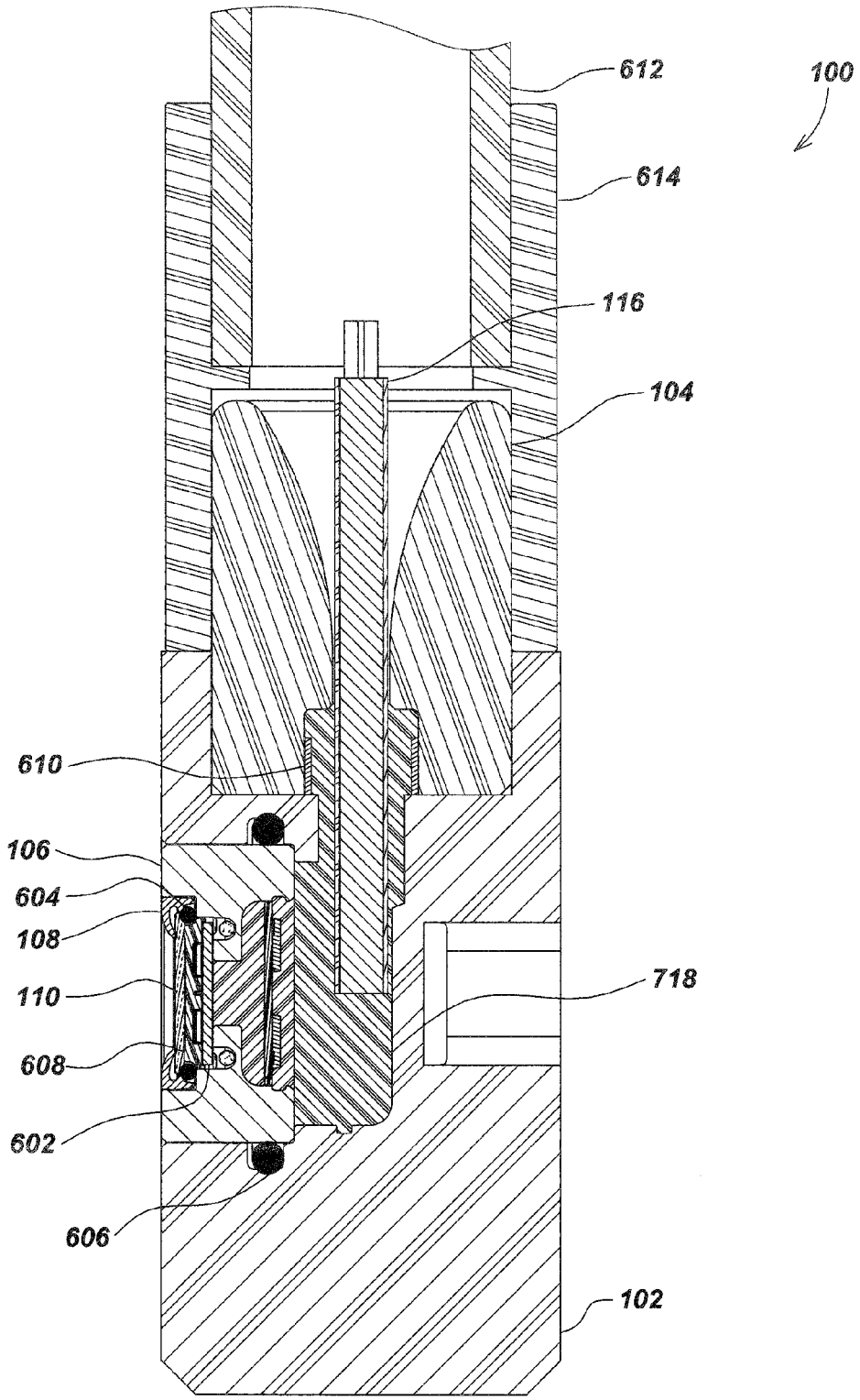
FIG. 6 is a section view showing details of construction of the illumination device embodiment of FIG. 1.

FIG. 6 illustrates a sectional view of luminaire embodiment 100, showing positioning of power supply wire 116 of an electrical power assembly. In an exemplary embodiment, strain relief element 104 includes a sloped inner channel or similar mechanism. Power supply wire 116 may then be retained by the sloped inner channel of strain relief element 104 and secured at the base of the strain relief element 104, such as by an Oetiker clamp 610 or similar or equivalent retention mechanism, before passing into the interior of the housing block 102 at a termination or proximal end. A supply or distal end of power supply wire 116 (not shown) may be coupled to external power, such as a shore power outlet or wiring, external battery, solar panel, generator, or other electrical power source.

Leads from the terminal end of power supply wire 116 may then pass through the back of the copper alloy fitting 106 and may be connected to one or more printed circuit boards (PCBs) and light emitting diodes (LEDs), which may be components of a light engine assembly 602 and may include LED driver electronics for providing and controlling electrical power to the LED elements. In some embodiments the LED driver electronics and/or the light engine assembly or associated components may be potted within the housing structure. Details of example embodiments of a light engine assembly which may comprise light engine assembly 602 are described in, for example, commonly assigned U.S. patent application Ser. No. 12/844,759 ('759 application), incorporated by reference herein. As shown in submersible luminaire embodiment 100, copper-alloy fitting 106 is in a different configuration, although of similar function, from the comparable component described in the '759 application. Additional details of various aspects of lighting engines and related components that may be included in various embodiments are further described in the Related Applications. In FIG. 6, the light engine assembly 602 comprises a PCB and an array of LEDs as described in the referenced '759 application, along with electronic circuitry to drive the LEDs and provide other power and/or control functions.

To facilitate mounting of the luminaire to a dock or other external structure, the outer diameter of strain relief element 104 may be sized to fit within a standard-sized PVC pipe, such as pipe 612 as shown in FIG. 6, thereby enabling the assembly to be readily attached to a length of PVC pipe using ordinary PVC gluing techniques and/or a standard PVC FxF coupler, such as coupler 614, for ease of mounting and/or for protecting the cable 116. The housing body 102 may be similar configured (not shown) to facilitate connection to a standard-sized PVC pipe or other plastic element. Similar mounting techniques may be used with other plastic or metallic materials, such as by using standard sized clamps, or other adhesives or attachment materials or hardware.

To facilitate sealing of the luminaire embodiment 100, a press-fit ring 108 may be seated within the port fitting 106 and may act to retain the transparent port window 110, which may be sealed by a port O-ring 604. Fitting 106 may be sealed within the housing block 102 by a fitting O-ring 606 as shown, or by another sealing mechanism. A support 608, which may comprise a metalized support structure or other support structure, may be positioned to sit behind the press-fit ring 108 to provide mechanical support to port 110.

Figure 7:
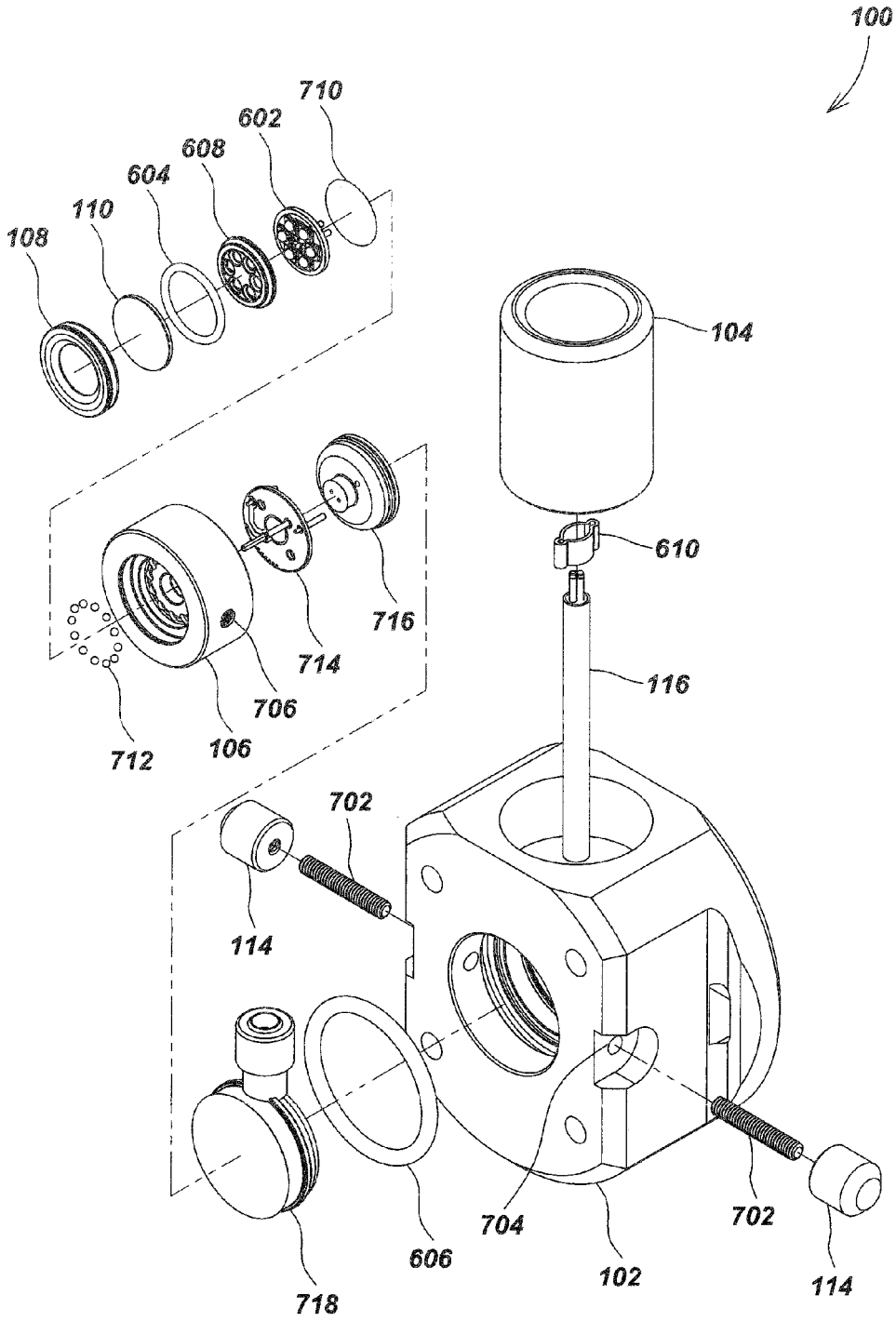
FIG. 7 is an exploded view 1 illustrating additional details of components of the illumination device embodiment of FIG. 1.

FIG. 7 illustrates an exploded view of various elements of luminaire embodiment 100. Power supply wire 116 and strain relief element 104 are shown removed from housing block 102. Fitting 106 may be backed by a corresponding sealing fitting O-ring 606. The light engine 602 may be seated behind press-fit ring 108, which may retain transparent port window 110. On either side of the fitting 106 a sacrificial zinc anode 114 may be fitted to the end of a threaded set-screw 702, which in assembly may be threaded through a formed hole 704 on either side of housing block 102 and anchored in a threaded receptacle 706 in the copper-alloy fitting 106. This configuration may be used to provide both a thermal path to ambient water when the luminaire is deployed, as well as an electrical path to prevent electrolytic damage by sacrificing the zinc anodes 114.

The port O-ring 604 may be used to seal the front cavity of the copper-alloy fitting 106 which may enclose, as well, the metalized support ring 608, the light engine 602, and a thermal compound layer 710 behind which an array of dessicant spheres 712 may be seated. Other embodiments may include sequestering agents, browning-agent destroyers and/or other compounds and configuration to reduce LED browning, such as those described in co-assigned U.S. patent application Ser. No. 13/482,969, entitled SEMICONDUCTOR LIGHTING DEVICES AND METHODS, filed May 29, 2012, the content of which is incorporated by reference herein. The rear opening in the copper-alloy fitting 106 may house a thermal protection PCB 714 retained by a rear potting compound 716. Thermal protection PCB 714 may include sensors and electronic control circuitry to monitor internal conditions such as temperature, pressure, moisture, or other parameters and limit or shut off LEDs and/or other elements of the LED light engine assembly to protect the luminaire against failure or damage. PCB 714 may include thermal foldback or shutoff circuitry and/or other sensor and electrical power monitoring and/or control circuitry to manage light output from the LED light engine during operation.

In a typical assembly operation a two-step potting process may be used. In this process, components of the luminaire, such as press-fit ring 108, transparent port window 110, light engine 602, port O-ring 604, metallic support 608, and thermal compound layer 710 backed by anti-dessicant spheres 712 or other sequestering agents/browning agent destroyers may be assembled with the fitting 106, which in an exemplary embodiment comprises copper or a copper alloy, and potted in a first potting step, along with the thermal protection PCB 714 and the rear potting compound module 716. The subassembly potted in this step may then be assembled into housing block 102 and potted in a second step into front potting module 718. The strain relief piece 104 may be glued in place last in sequence. (Note that the potting compound modules 716 and 718 are shown in FIGS. 6 & 7 in their cured shapes after potting to conform to the internal shape of the housing block).

Figure 8:
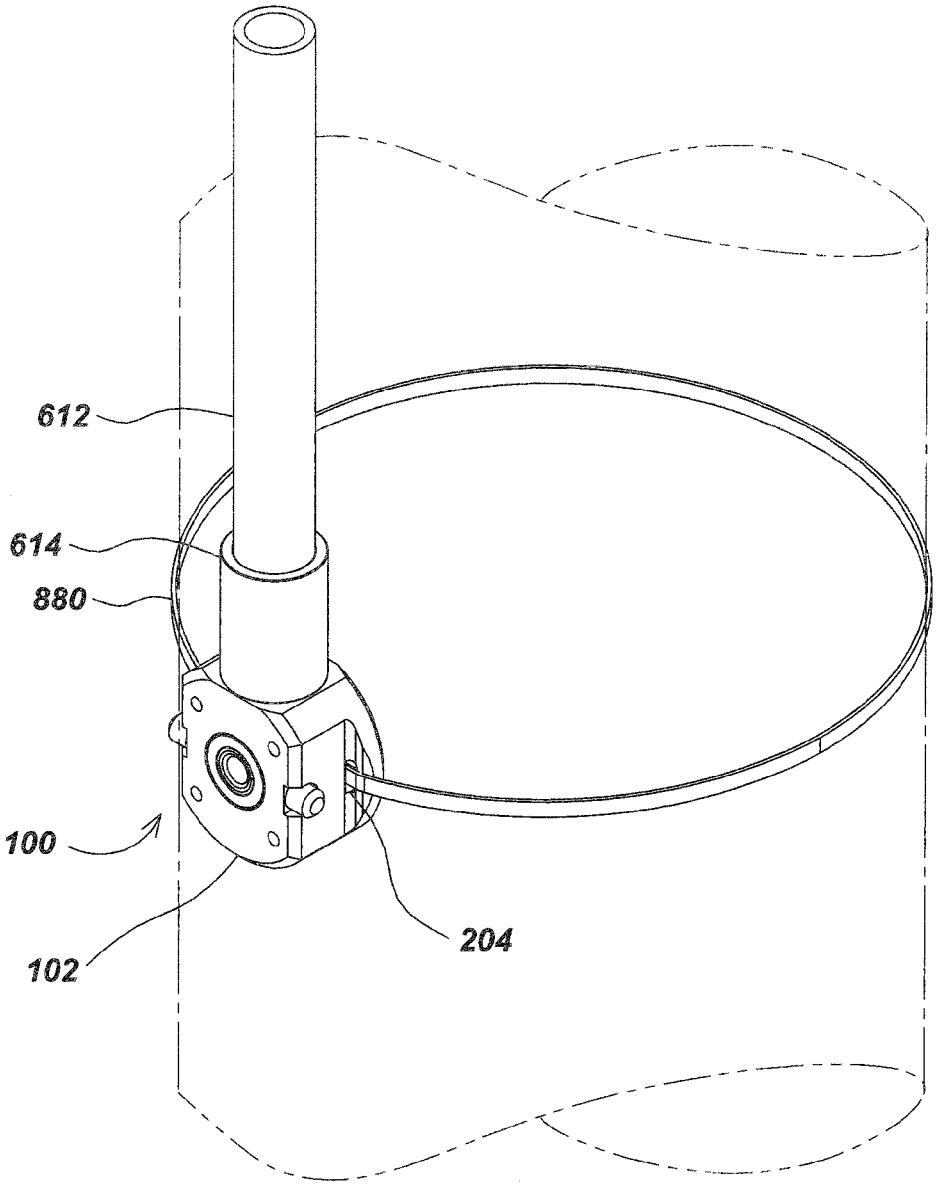
FIG. 8 illustrates an example mounting configuration for attaching an illumination device to a dock or piling.

FIG. 8 illustrates example details of a mounting configuration for attaching a submersible lighting apparatus, such as luminaire embodiment 100, to a pier, piling, dock, or other external structure. In this configuration a strap or ring assembly 880 may be positioned through a slot in the luminaire 100 and secured to the pier (or other) structure. In addition, pipe 612 may be further attached (not shown) to a mounting structure for alternate or additional support.

Figure 9:
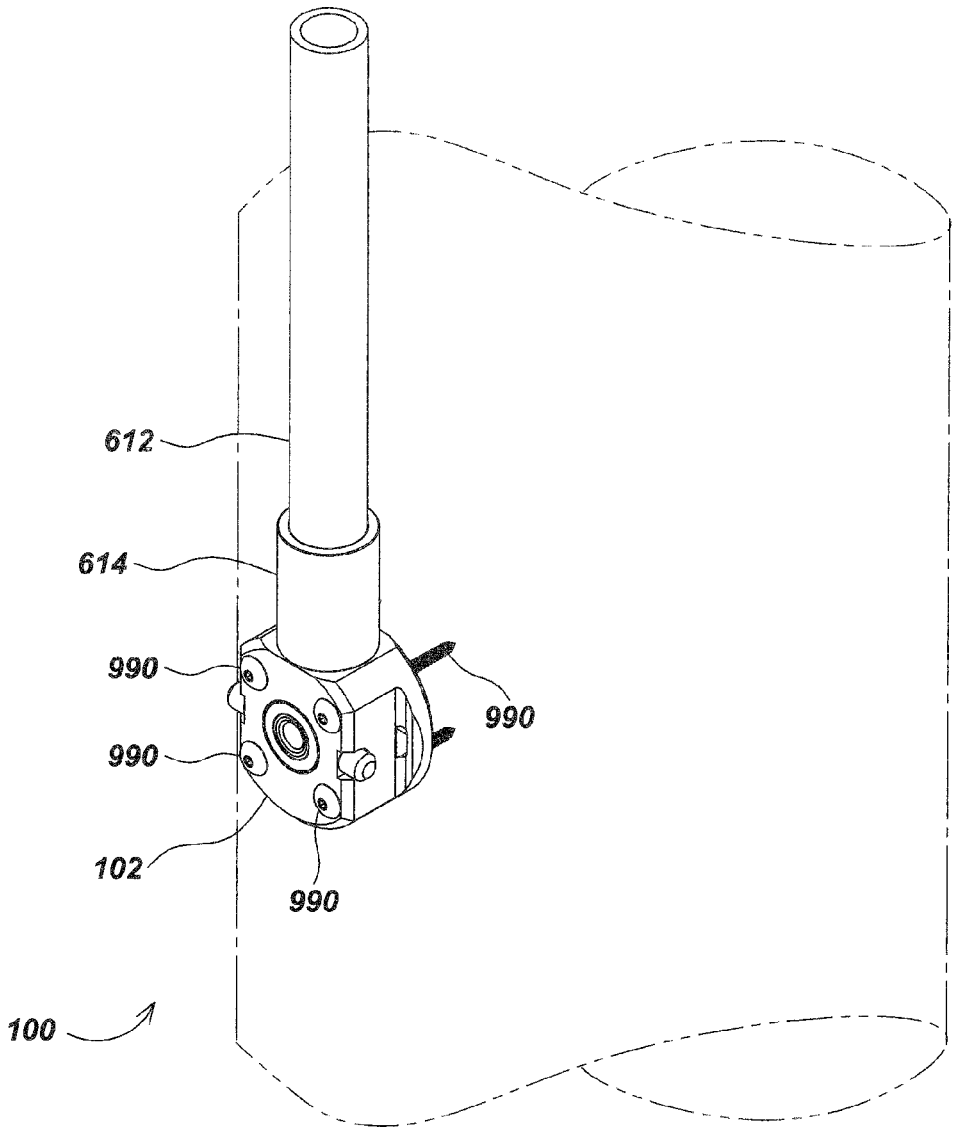
FIG. 9 illustrates another example mounting configuration for attaching an illumination device to a dock or piling.

FIG. 9 illustrates example details of another mounting configuration for attaching a submersible lighting apparatus, such as luminaire embodiment 100, to a pier, piling, dock or other external structure. In this configuration, luminaire 100 may be attached using mounting bolts or screws 990 through the housing body and into the pier or other structure. In addition, pipe 612 may be further attached (not shown) to a mounting structure for alternate or additional support.

Figure 10:
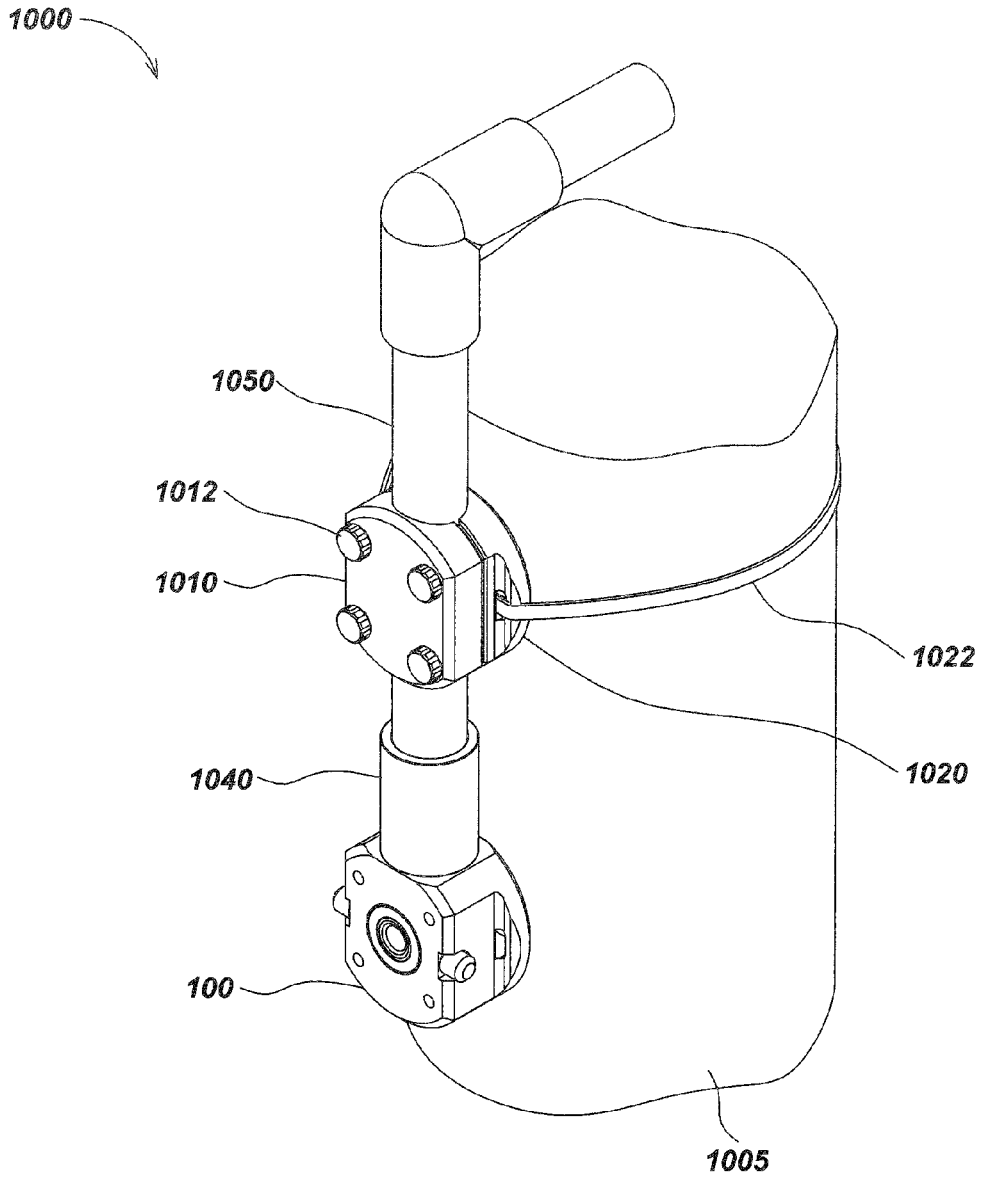
FIG. 10 illustrates details of an embodiment of a lighting apparatus mounted on a pier piling or similar structure.

FIG. 10 illustrates an example embodiment 1000 of a lighting apparatus, such as lighting apparatus or luminaire embodiment 100 of FIG. 1, mounted on a piling, such as a pier piling 1005 or other similar aquatic structure. As shown in FIG. 10, luminaire 100 may be coupled to a strain relief element 1040 of the housing, which may be a glued-on or threaded to a PVC pipe or other pipe or structure 1050. The pipe 1050 may pass through and be tightened to a mounting bracket assembly embodiment for coupling to the piling 1005. The mounting bracket assembly may include, for example, an outer plate 1010, an inner plate 1020, screws or bolts 1012, and a strap 1022. The outer and inner plates may include a curved surface to be tightened against the pipe 1050 to create a pressure fit. Other attachment mechanisms may also be used in alternate embodiments.

Wiring from the luminaire 100 may be fed through the strain relief 1040 and pipe 1050 to an electrical power supply, which may be above water, such as a DC or AC power supply, battery, or other electrical power source. In some embodiments the power supply may be housed so as to be mounted underwater, such as by using an enclosed battery or other electrical power source.

In operation, luminaire 100 may be readily removed for cleaning, maintenance, replacements, etc., by loosening the bolts or screws 1012 and/or the strap 1022 and lifting the luminaire and pipe 1050 from the water. If PVC or other plastic pipes are glued together, the luminaire may be replaced by cutting the pipe and either splicing additional pipe sections together or gluing a replacement luminaire to the remaining pipe section. If threaded connections are used the luminaire may be replaced by unscrewing the luminaire and screwing on a new one.

Figure 11:
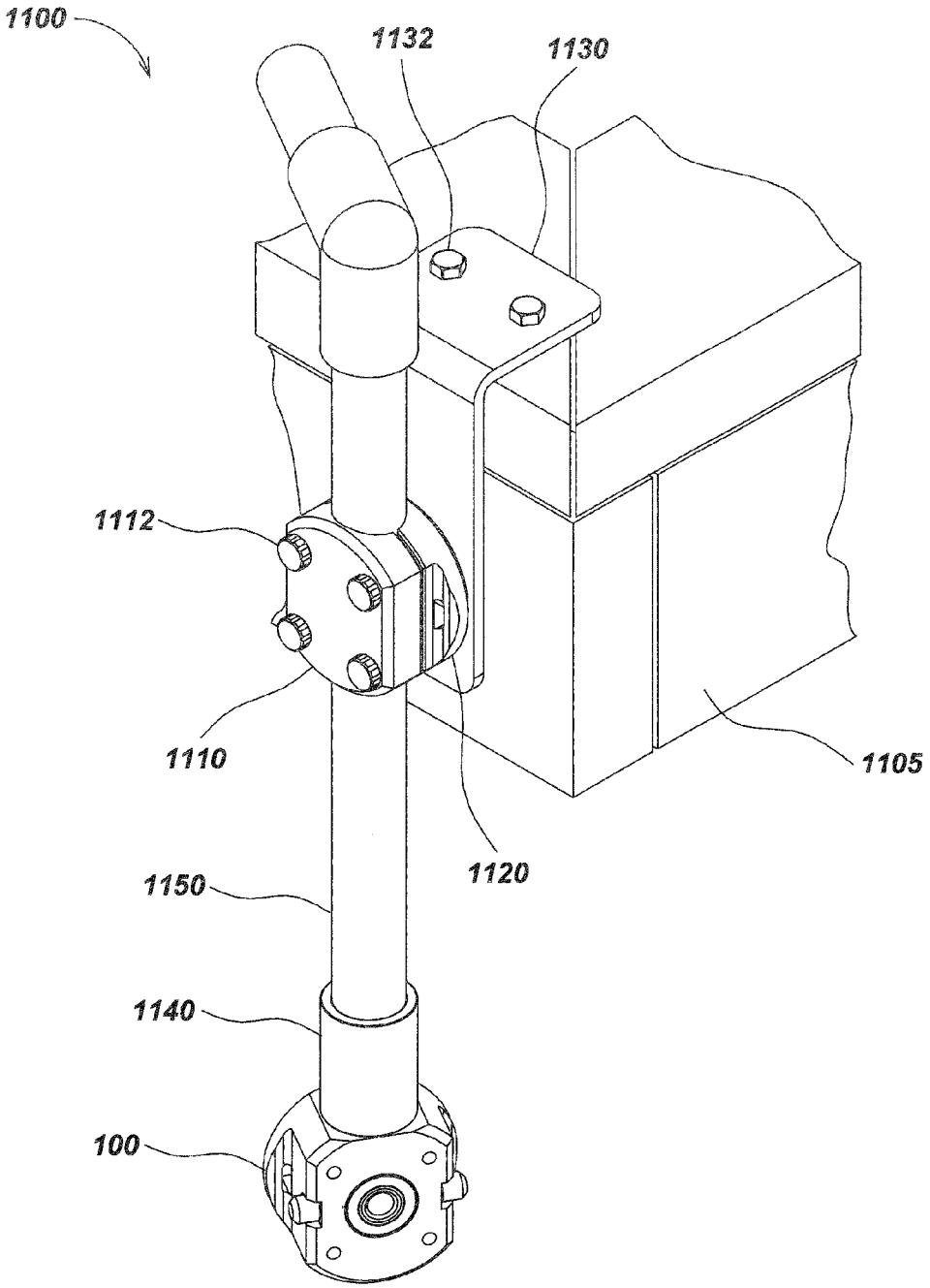
FIG. 11 illustrates details of an embodiment of a lighting apparatus mounted on a dock, barge, or similar structure.

FIG. 11 illustrates an example embodiment 1100 of a lighting apparatus, such as lighting apparatus or luminaire embodiment 100 of FIG. 1, mounted on a dock, barge, or similar structure in an analogous fashion to the pier mounting configuration of FIG. 10. As shown in FIG. 11, luminaire 100 may be coupled to a strain relief element 1140 of the housing, which may be a glued-on or threaded to a PVC pipe or other pipe or structure 1150. The pipe 1150 may pass through and be tightened to a mounting bracket assembly embodiment for coupling to the piling 1105. The mounting bracket assembly may include, for example, an outer plate 1110, an inner plate 1120, screws or bolts 1112, a bracket 1130, and bracket screws or bolts 1132. The outer and inner plates may include a curved surface to be tightened against the pipe 1050 to create a pressure fit. Other attachment mechanisms may also be used in alternate embodiments. The bracket 1130 may be glued, welded, screwed, bolted, or otherwise attached to the inner plate 1120, and may be shaped to confirm to the shape of the dock (e.g., a right angle or other-shaped configuration depending on the dock shape).

Wiring from the luminaire 100 may be fed through the strain relief 1140 and pipe 1150 to an electrical power supply, which may be above water, such as a DC or AC power supply, battery, or other electrical power source. In some embodiments the power supply may be housed so as to be mounted underwater, such as by using an enclosed battery or other electrical power source.

In operation, luminaire 100 may be readily removed for cleaning, maintenance, replacements, etc., by loosening the bolts or screws 1112 and/or the strap 1122 and lifting the luminaire and pipe 1150 from the water. If PVC or other plastic pipes are glued together, the luminaire may be replaced by cutting the pipe and either splicing additional pipe sections together or gluing a replacement luminaire to the remaining pipe section. If threaded connections are used the luminaire may be replaced by unscrewing the luminaire and screwing on a new one.

Lighting apparatus as described herein, as well as mounting structures or assembly embodiments as shown in FIG. 10 or 11, or similar or equivalent configurations, may also be used to mount lighting apparatus to boats, barges or other vessels, or other structures on or in water or other liquid or humid environments in various applications.

Various embodiments of submersible luminaries, such as the exemplary embodiment 100 as shown, may be used to advantageously facilitate deployment of reliable LED lighting, including a robust, simple design which is thermally balanced, resistant to corrosion and fouling, and easily deployable.

It is noted that the disclosed elements and features herein may be combined with the various elements and features described in the Related Applications in additional embodiments of lighting apparatus or luminaires for use in various underwater, littoral, or above-water applications, such as where humidity or moisture exposure are present.

It is noted that the term "exemplary" as used herein means "serving as an example, instance, or illustration." Any aspect, detail, function, implementation, and/or embodiment described herein as "exemplary" is not necessarily to be construed as preferred or advantageous over other aspects and/or embodiments.

The scope of the present invention is not intended to be limited to the aspects shown and described previously herein, but should be accorded the full scope consistent with the language of the appended Claims and their equivalents, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c.

The previous description of the disclosed aspects is provided to enable any person skilled in the art to make or use the present invention. Various modifications to these aspects will be readily apparent to those skilled in the art, including additions of elements or features disclosed in the incorporated Related Applications, and the generic principles defined herein may be applied to other aspects without departing from the spirit or scope of the disclosure. Thus, the presently claimed invention is not intended to be limited to the aspects shown herein but is to be accorded the widest scope consistent with the appended Claims and their equivalents.

We claim:

1. A submersible lighting apparatus, comprising:

a PVC housing block;

a metallic LED light engine assembly potted within the PVC housing block;

a port assembly including a sapphire port and a copper or copper alloy fitting disposed on the PVC housing block;

a zinc anode disposed in contact with the port assembly, the zinc anode configured to retain the port assembly in the PVC housing block; and an electrical power assembly including a strain relief element coupled to the PVC housing block and a wire assembly coupled to the LED light engine.

2. The lighting apparatus of claim 1, further including a strap assembly, wherein the housing block includes an a slot through which the strap assembly passes for securing the lighting apparatus to a pier or other external structure.

3. The lighting apparatus of claim 1, wherein a sequestering agent or browning agent destroyer, comprising one or more dessicant spheres, is disposed within the housing block.

4. The lighting apparatus of claim 1, wherein the fitting is exposed to the exterior of the lighting assembly to mitigate underwater fouling.

5. The lighting apparatus of claim 4, wherein one or more of the LEDs of the light assembly are blue or ultraviolet LEDs operating at a wavelength or wavelength range selected to mitigate underwater fouling of the transparent port window.

6. The lighting apparatus of claim 1, wherein the housing block is formed or molded as a single plastic element.

7. The lighting apparatus of claim 1, wherein one or more of the LED lights are LED lights for generating ultraviolet light for inhibiting marine fouling.

8. The lighting apparatus of claim 1, wherein the housing assembly includes a pipe coupling structure configured to be coupled to a standard pipe element, further comprising another port assembly for providing light in a directional angle ninety degrees or greater than the light provided from the port assembly.

9. The lighting apparatus of claim 1, wherein the housing block includes one or more slotted ears for flush mounting to an attachment structure.

10. The lighting apparatus of claim 1, wherein the housing block includes a side recess and opening in the side recess for coupling to an attachment structure.

11. The lighting apparatus of claim 10, further comprising a sequestering agent or browning agent destroyer potted with a thermal compound layer, light engine and thermal protection PCB.

12. The lighting assembly of claim 1, further comprising a thermal foldback or shutoff circuit coupled to the LED light engine assembly to control LED light output in response to thermal overheating conditions.

13. The lighting assembly of claim 1, wherein the housing block has a flat face or smoothly-curved face, and a front face of the port assembly and LED light engine assembly are positioned to be substantially flush with the flat face or smoothly curved face to facilitate cleaning of the lighting assembly.

14. The lighting apparatus of claim 1, further comprising a sequestering agent or browning agent destroyer disposed within the PVC housing block.

* * * * *